US006804971B2

(12) United States Patent
Lee

(10) Patent No.: US 6,804,971 B2
(45) Date of Patent: Oct. 19, 2004

(54) APPARATUS AND METHOD FOR CONTROLLING COMPRESSORS OF AIR CONDITIONER

(75) Inventor: Won Hee Lee, Seoul-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/397,249

(22) Filed: Mar. 27, 2003

(65) Prior Publication Data

US 2004/0098994 A1 May 27, 2004

(30) Foreign Application Priority Data

Nov. 22, 2002 (KR) ..... 10-2002-73105

(51) Int. Cl.[7] ..... F25B 7/00

(52) U.S. Cl. ..... 62/175; 62/228.5; 62/231; 417/12; 417/53; 417/426

(58) Field of Search ..... 62/175, 157, 231, 62/226.5, 229; 417/1, 5, 7, 12, 53, 286, 287, 290, 426; 236/1 EA

(56) References Cited

U.S. PATENT DOCUMENTS 4,939,909 A * 7/1990 Tsuchiyama et al. ..... 62/158
5,123,256 A * 6/1992 Oltman ..... 62/175
5,454,229 A * 10/1995 Hanson et al. ..... 62/126
6,474,085 B2 * 11/2002 Uno et al. ..... 62/175
6,519,957 B2 * 2/2003 Huh et al. ..... 62/175
6,568,197 B2 * 5/2003 Uno et al. ..... 62/175
6,722,576 B1 * 4/2004 Lee et al. ..... 237/2 B
2004/0003605 A1 * 1/2004 So et al. ..... 62/157

FOREIGN PATENT DOCUMENTS

JP 360099946 A * 6/1985 ..... F24F/11/02
JP 401312359 A * 12/1989 ..... F25B/1/00
JP 405141749 A * 6/1993 ..... F24F/11/02
JP 407167505 A * 7/1995 ..... F25B/1/00

* cited by examiner

*Primary Examiner*—Marc Norman
(74) *Attorney, Agent, or Firm*—Greenblum & Bernstein, P.L.C.

(57) ABSTRACT

Disclosed are an apparatus and a method for controlling a plurality of compressors of an air conditioner. The apparatus comprises a counter, a timer, and a controller. The counter serves to count the number of times of operations/stoppages of the plural compressors according to loads. The timer serves to sense a time taken for the plural compressors to be operated/stopped a designated number of times counted by the counter. The controller serves to control the operations of the plural compressors based on the time sensed by the timer. The apparatus senses the time taken for the plural compressors to be operated/stopped the designated number of times, and determines whether or not a load is eliminated based on the sensed time, thereby properly controlling the operations of the compressors. Accordingly, the apparatus of the present invention reduces the consumption of power and increases air conditioning efficiency of the compressors.

12 Claims, 4 Drawing Sheets

APPARATUS AND METHOD FOR CONTROLLING COMPRESSORS OF AIR CONDITIONER

BACKGROUND OF THE INVENTION

1. Field of the Invention

The present invention relates to an apparatus and a method for controlling compressors of an air conditioner.

2. Description of the Related Art

Generally, an air conditioner is an appliance for cooling or heating a room such as a house, a restaurant, or an office. The air conditioner comprises a compressor, a condenser, an expansion device, an evaporator, and a refrigerant pipe. The compressor serves to compress a refrigerant into a high-temperature and high-pressure gaseous state. The condenser serves to condense the refrigerant passing through the compressor into a high-temperature and high-pressure liquid state. The expansion device serves to decompress the refrigerant passing through the condenser into a low-temperature and low-pressure liquid state. The evaporator serves to evaporate the refrigerant passing through the expansion device into a low-temperature and low-pressure gaseous state. The compressor, the condenser, the expansion device, and the evaporator are connected by the refrigerant pipe.

A heat pump-type air conditioner further comprises a direction change valve, such as a 3-way valve or a 4-way valve, adapted to change the flow direction of the refrigerant based on a cooling/heating purpose, thereby being selectively operated in a cooling or heating mode.

In the cooling mode of the air conditioner, an outdoor heat exchanger serves as the condenser, and an indoor heat exchanger serves as the evaporator. On the other hand, in the heating mode of the air conditioner, the outdoor heat exchanger serves as the evaporator, and the indoor heat exchanger serves as the condenser.

In the cooling mode, the air conditioner allows indoor air to pass through the indoor heat exchanger serving as the evaporator, thereby discharging cold air. In the heating mode, the air conditioner allows indoor air to pass through the indoor heat exchanger serving as the condenser, thereby discharging warm air.

Recent air conditioners have employed a plurality of compressors having different capacities so that the plural compressors are simultaneously or selectively operated in accordance with cooling or heating loads. Accordingly, it is possible to properly cope with the cooling or heating load, thereby optimizing the cooling or heating efficiency of the air conditioner.

In order to determine the refrigerant compression capacity of the compressors of the air conditioner, the cooling or heating load must be correctly measured. Generally, the load is determined by the difference between a room temperature and a target temperature ($T_0$) designated by a user.

Herein, an upper limit target temperature ($T_0$+) and a lower limit target temperature ($T_0$−) of the target temperature ($T_0$) are set by an allowable temperature deviation. When the room temperature (T) deviates from the range of the target temperature ($T_0$), a plurality of the compressors are simultaneously operated or stopped, or partially operated or stopped.

FIG. 1 is a graph depicting a variation in compression capacity of compressors depending on a variation in room temperature in a conventional air conditioner employing plural compressors.

With reference to FIG. 1, when the air conditioner is operated in a heating mode, the variation in room temperature is described. When the room temperature (T) is increased and reaches the upper limit target temperature ($T_0$+) by the operation of the air conditioner in the heating mode, the compressors of the air conditioner are stopped. When the room temperature (T) is decreased and becomes lower than the lower limit target temperature ($T_0$−), the compressors of the air conditioner are re-operated.

Here, when the compressors of the air conditioner are initially operated, the room temperature (T) is gradually increased to the upper limit target temperature ($T_0$+) at an initial stage of the heating mode. However, when the compressors of the air conditioner are re-operated, the room temperature is relatively rapidly increased to the upper limit target temperature ($T_0$+).

It is concluded that the load to be eliminated by the re-operations of the compressors is smaller than the load to be eliminated by the initial operations of the compressors under the same room temperature.

The reason is that the load is substantially affected by various external factors such as latent heat in the room air.

As aforementioned, the conventional air conditioner cannot correctly determine the load only by means of the difference between the room temperature (T) and the target temperature ($T_0$), thus not being capable of rapidly eliminating the load. Further, a plurality of the compressors of the conventional air conditioner are unnecessarily operated or stopped simultaneously, thereby degrading the operational reliability of the compressors.

SUMMARY OF THE INVENTION

Therefore, the present invention has been made in view of the above problems, and it is an object of the present invention to provide an apparatus for controlling compressors of an air conditioner, which correctly determines loads, thereafter effectively operating the plural compressors, thereby rapidly eliminating the loads and preventing the unnecessary operations of the compressors.

It is another object of the present invention to provide to a method for controlling compressors of an air conditioner, which correctly determines loads based on room temperature, target temperature, and a variation in the room temperature, thereby effectively operating the plural compressors.

In accordance with one aspect of the present invention, the above and other objects can be accomplished by the provision of an apparatus for controlling a plurality of compressors of an air conditioner, comprising: a counter for counting the number of times of operations/stoppages of the plural compressors according to loads; a timer for sensing a time (t) taken for the plural compressors to be operated/stopped a designated number of times counted by the counter; and a controller for controlling the operations of the plural compressors based on the time (t) sensed by the timer.

Preferably, the timer may sense the time (t) taken for the plural compressors to be operated/stopped two times.

Further, preferably, the controller may include a comparison unit for comparing the time (t) sensed by the timer to a designated time ($t_0$), thereby determining whether the load is eliminated.

Preferably, the timer may be reset when a control signal regarding the time (t) sensed by the timer is transmitted to the controlling unit, and the counter may be reset when the timer is reset.

Further, preferably, the comparison unit may determine the load to be eliminated when the time (t) sensed by the timer is not more than the designated time ($t_0$), and may determine the load not to be eliminated when the time (t) sensed by the timer is more than the designated time ($t_0$).

Moreover, preferably, the controller may operate a part of the plural compressors when it is determined that the load is eliminated, and may operate all of the plural compressors when it is determined that the load is not eliminated.

In accordance with another aspect of the present invention, there is provided a method for controlling a plurality of compressors of an air conditioner, comprising the steps of: (a) repeating operations/stoppages of the plural compressors according to loads; (b) sensing a time (t) taken for the plural compressors to be operated/stopped a designated number (n) of times at the step (a); (c) determining whether or not the load is eliminated based on the time (t) sensed at the step (b); and (d) selectively operating a part of the plural compressors when it is determined that the load is eliminated from the result obtained by the step (c).

Preferably, the time (t) sensed at the step (b) may be taken for the plural compressors to be operated/stopped two times.

Further, preferably, the step (c) may include the steps of: (c-1) determining the load to be eliminated when the sensed time (t) is not more than a designated time ($t_o$); and (c-2) determining the load not to be eliminated when the sensed time (t) is more than the designated time ($t_o$)

Preferably, the step (c) may include the step of (c-3) being reset based on a result obtained by comparing the sensed time (t) to a designated time ($t_o$)

Moreover, preferably, the step (d) may include the steps of (d-1) operating/stopping the plural compressors the designated number (n) of times at the step (b) when it is determined that the load is not eliminated at the step (c).

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the annexed drawings.

Figure 1:
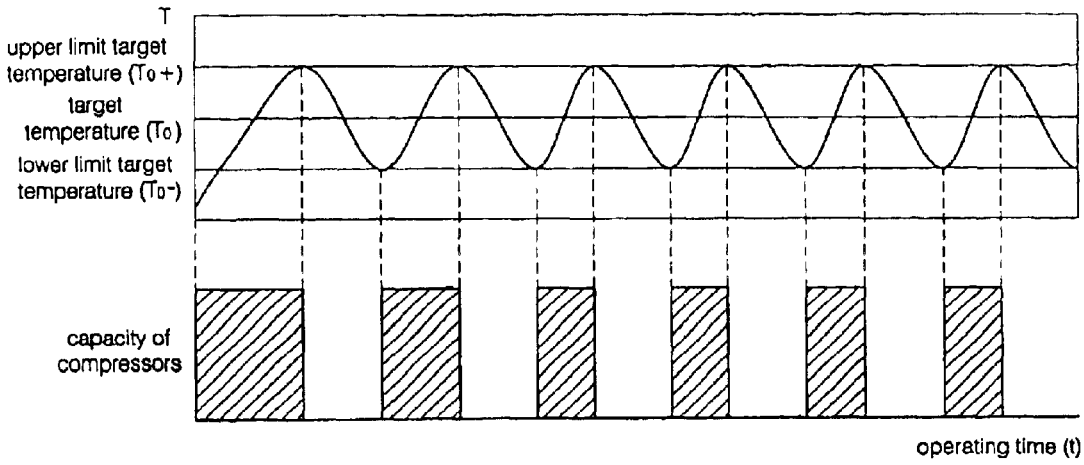
FIG. 1(Prior Art)
FIG. 1 is a graph depicting a variation in compression capacity depending on a variation in room temperature in a conventional air conditioner.
Figure 2:
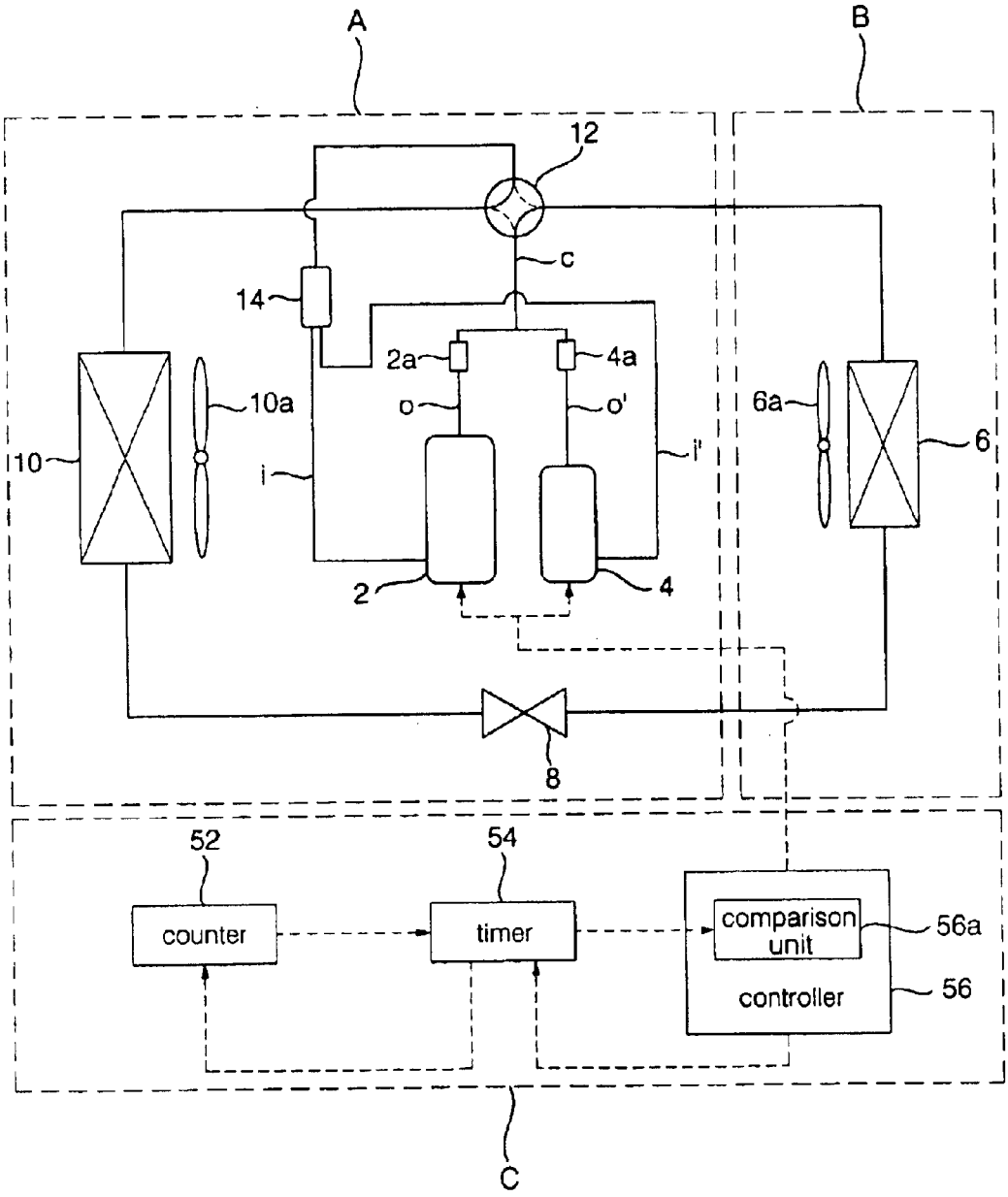
FIG. 2 is a schematic view of an air conditioner in accordance with the present invention.

As shown in FIG. 2, an air conditioner in accordance with the present invention comprises an outdoor unit A and an indoor unit B which are connected to each other via a refrigerant pipe, and a control apparatus C for controlling the operations of compressors of the outdoor unit B.

The outdoor unit A includes first and second compressors 2 and 4, an expansion device 8, an outdoor heat exchanger 10, an outdoor fan 10*a*, an oil separating means 14, and a refrigerant pipe connecting such components and provided with a plurality of check valves 2*a* and 4*a*. The indoor unit B includes an indoor heat exchanger 6 and an indoor fan 6*a*.

More specifically, outlet pipes o and o' are connected to rear ends of the first and second compressors 2 and 4, respectively. In order to prevent the backflow of the refrigerant into the first and second compressors 2 and 4, the first and second check valves 2*a* and 4*a* are installed in the outlet pipes o and o'. A connection pipe c is connected to the outlet pipes o and o' so that the refrigerants from the two outlet pipes o and o' are joined together and guided to a condenser, the expansion device, and an evaporator of the air conditioner.

Inlet pipes i and i' are branched from the end of the connection pipe c, and connected to the first and second compressors 2 and 4 so as to guide the refrigerant to the first and second compressors 2 and 4. The oil separating means 14 is positioned between the connection pipe c and the inlet pipes i and i', and serves to separate from the refrigerants oils discharged together with the refrigerants from the first and second compressors 2 and 4, and subsequently to supply the separated oils to the corresponding first and second compressors 2 and 4.

Here, a direction change valve 12 for selectively controlling the flow direction of the refrigerant is installed in the connection pipe c connected to the rear ends of the first and second check valves 2*a* and 4*a*. The direction change valve 12 allows the refrigerant to flow toward the outdoor heat exchanger 10, thereby forming a cooling cycle, or to flow toward the indoor heat exchanger 6, thereby forming a heating cycle.

The first compressor 2 has a refrigerant compression capacity of (100-X) %, and the second compressor 4 has a refrigerant compression capacity of X %. Accordingly, the first and second compressors 2 and 4 are simultaneously or selectively operated according to loads to be eliminated.

The outdoor fan 10*a* is installed adjacent to the outdoor heat exchanger 10, and the indoor fan 6*a* is installed adjacent to the indoor heat exchanger 6. Accordingly, the outdoor fan 10*a* and the indoor fan 6*a* have variations in their rotational speeds based on a variation in the load, thereby controlling the amount of blowing outdoor air and indoor air, respectively.

The control apparatus C includes a counter 52, a timer 54, and a controller 56. The counter 52, the timer 54, and the controller 56 are operated together with the first and second compressors 2 and 4 by electrical signals, thereby causing the control apparatus C to control the operations of the first and second compressors 2 and 4.

The counter 52 determines whether the room temperature reaches an allowable range of the target temperature ($T_0$) during the operation of the air conditioner, thereby counting the number of times of the simultaneous operations/stoppages of the first and second compressors 2 and 4, and subsequently transmitting a control signal regarding the counted number to the timer 54.

The timer 54 senses a time (t) taken for the first and second compressors 2 and 4 to be operated/stopped two times by means of the counter 52, and subsequently transmits a control signal regarding the sensed time (t) to the controller 56.

The controller 56 further includes a comparing unit 56*a*, which compares the time (t) sensed by the timer 54 to a designated time ($t_0$), thereby determining whether the load is eliminated or not. When the sensed time (t) is not more than the designated time ($t_0$), the comparison unit 56*a* determines the load to be eliminated. When the sensed time (t) is more than the designated time ($t_0$), the comparison unit 56*a* determines the load not to be eliminated.

When the comparison unit 56*a* determines the load to be eliminated, the controller 56 operates either of the first and second compressors 2 and 4, and when the comparison unit 56*a* determines the load not to be eliminated, the controller 56 operates all of the first and second compressors 2 and 4.

After the control signal regarding the time (t) sensed by the timer 54 is transmitted to the controller 56, the timer 54 is reset, and subsequently the counter 52 is also reset. Thereafter, the counter senses again the time (t) taken for the first and second compressors 2 and 4 to be operated/stopped two times.

Figure 3:
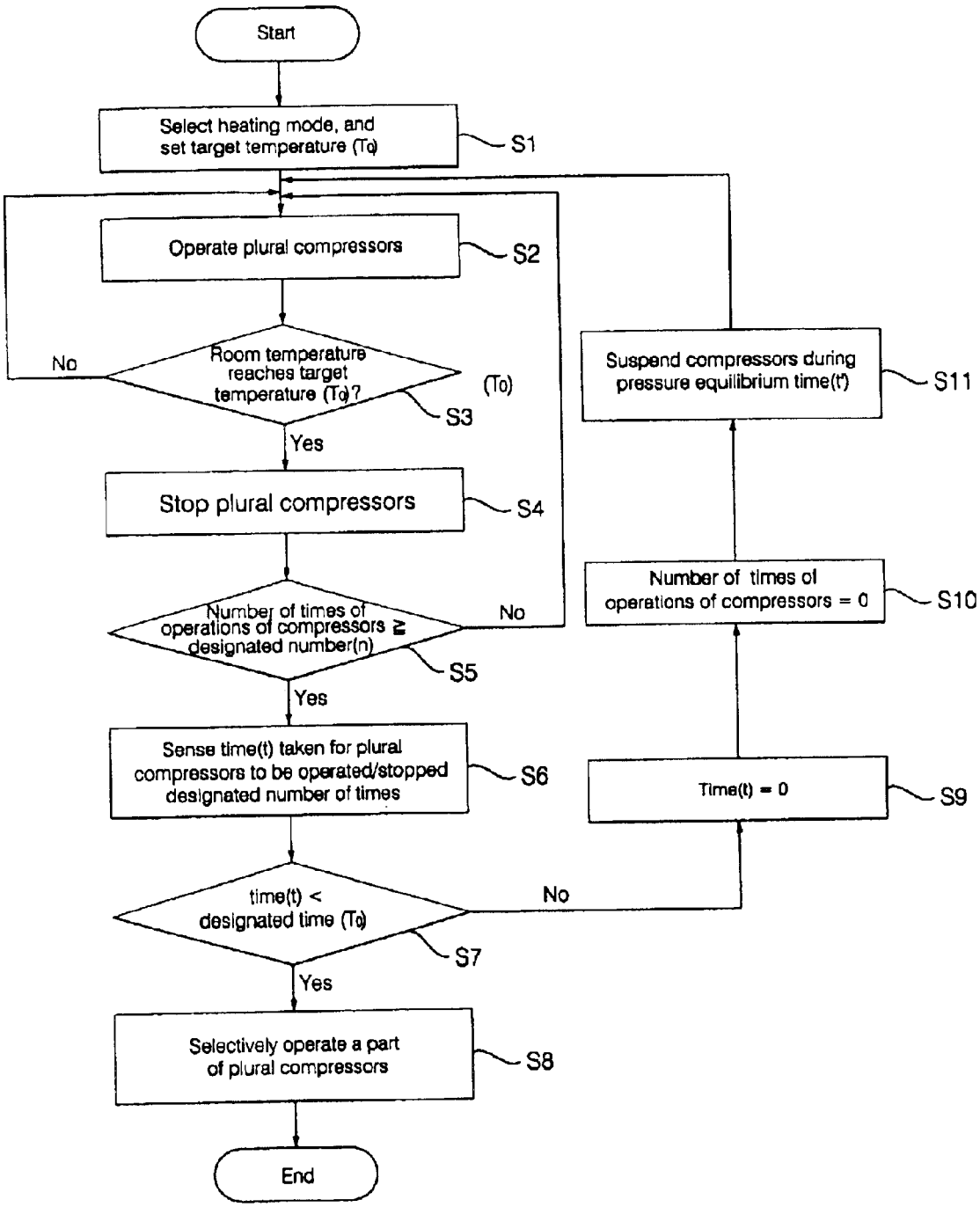
FIG. 3 is a flow chart illustrating a method for controlling compressors of the air conditioner in accordance with the present invention.

Hereinafter, with reference to FIG. 3, a method for controlling the compressors of the air conditioner in the heating mode in accordance with the present invention is described.

The heating mode is selected and a desirable target temperature ($T_0$) is set by the manipulation of a user (S1). When the target temperature ($T_0$) is higher than current room temperature (T), the first and second compressors 2 and 4 are simultaneously operated (S2).

Here, an upper limit target temperature ($T_0$+) and a lower limit target temperature ($T_0$−) are set by an allowable deviation of the target temperature ($T_0$). The operation of the air conditioner is controlled so that the room temperature is maintained between the upper limit target temperature ($T_0$+) and the lower limit target temperature ($T_0$−).

The refrigerant circulates through the compressors 2 and 4, the indoor heat exchanger 6, the expansion device 8, and the outdoor heat exchanger 10 by the operations of the first and second compressors 2 and 4, and subsequently causes the indoor fan 6*a* to discharge indoor air toward the indoor heat exchanger 6 and simultaneously the outdoor fan 10*a* to discharge outdoor air toward the outdoor heat exchanger 10.

Here, the indoor heat exchanger 6 serves as a condenser for heat-exchanging indoor air with the refrigerant, thereby heating the indoor air and allowing the air conditioner to be operated in the heating mode. The outdoor heat exchanger 10 serves as an evaporator.

It is determined whether or not the room temperature (T) reaches the upper limit target temperature ($T_0$+) during the operations of the first and second compressors 2 and 4 (S3). When the room temperature (T) reaches the upper limit target temperature ($T_0$+), the first and second compressors 2 and 4 are stopped (S4).

On the other hand, when the room temperature (T) does not reach the upper limit target temperature ($T_0$+), the first and second compressors 2 and 4 maintain their operations (S4).

When the first and second compressors are simultaneously stopped, it is determined whether the number of times of the operations/stoppages of the first and second compressors 2 and 4 are more than a designated number (n) (S5). Then, when it is determined that the number of times of the operations/stoppages of the first and second compressors 2 and 4 is more than the designated number (n), the time (t) taken for the first and second compressors 2 and 4 to be operated/stopped the designated number (n) of times is sensed (S6).

The stoppages of the first and second compressors 2 and 4 when the room temperature (T) is increased to the upper limit target temperature ($T_0$+), and the re-operations of the first and second compressors 2 and 4 when the room temperature (T) is decreased to the lower limit target temperature ($T_0$−) are continuously repeated.

Here, the designated number (n) is two times. Accordingly, the time (t) taken for the first and second compressors 2 and 4 to be operated/stopped two times from a time of beginning to operate is cumulatively sensed.

The time (t) taken for the first and second compressors 2 and 4 to be operated/stopped is compared to a designated time ($t_0$) (S7). When the time (t) taken for the first and second compressors 2 and 4 to be operated/stopped is not more than the designated time ($t_0$), either of the first and second compressors 2 and 4 is selectively operated (S8).

In this case, it is concluded that a heating load is eliminated by the operation of only one of the first and second compressors 2 and 4.

When the time (t) taken for the first and second compressors 2 and 4 to be operated/stopped is more than the designated time ($t_0$), the time (t) is reset to be "0" (S9), and the number of the operations/stoppages of the first and second compressors 2 and 4 is reset to be "0" (S10). Then, the first and second compressors 2 and 4 are suspended during a time (t') taken for pressures at inlets and outlets of the stopped compressors to be equilibrated (S11).

Here, it is determined that the heating load is eliminated by the operations of the first and second compressors 2 and 4. Accordingly, the operations/stoppages of the first and second compressors 2 and 4 are continuously repeated.

Figure 4:
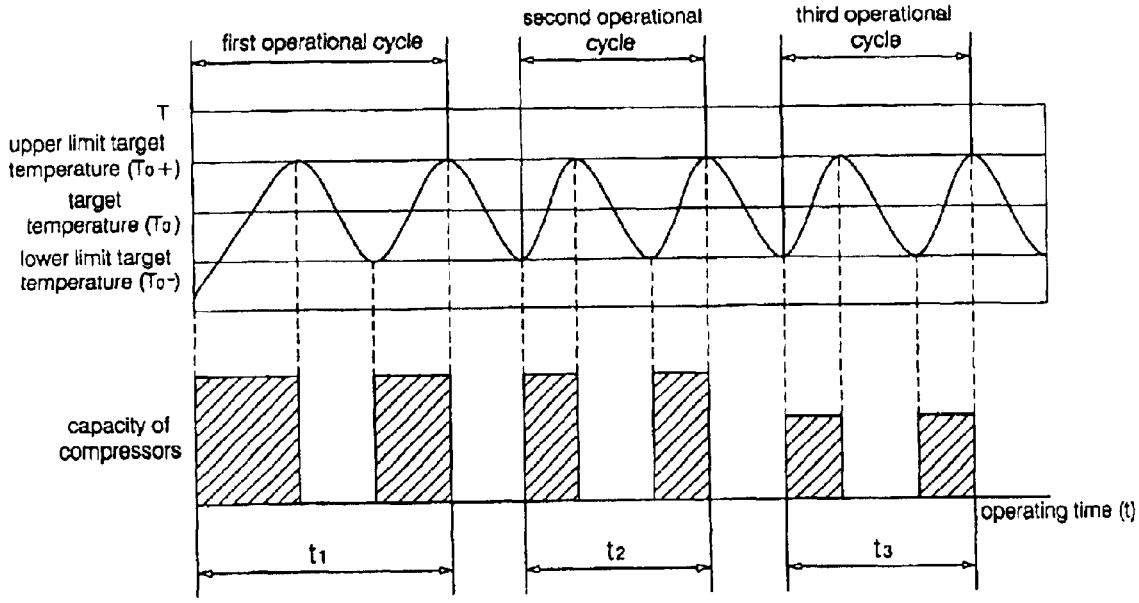
FIG. 4 is a graph depicting a variation in compression capacity depending on a variation in room temperature in the air conditioner in accordance with the present invention.

Hereinafter, with reference to FIG. 4, a variation in compression capacity of the compressors depending on a variation in room temperature in the air conditioner in accordance with the present invention.

In a first operation cycle, the plural compressors of the air conditioner are operated until the room temperature (T) reaches the upper limit target temperature ($T_0$+), and subsequently stopped when the room temperature (T) is decreased to the lower limit target temperature ($T_0$−).

Accordingly, the room temperature (T) is increased and decreased by the operations/stoppages of the plural compressors of the air conditioner. Thereafter, the plural compressors of the air conditioner repeat their operations/stoppages based on the variation of the room temperature (T).

Here, a time (t1) taken for the plural compressors to be operated/stopped two times in the first operation cycle is sensed. When the sensed time (t1) is more than the designated time ($t_0$), it is determined that the heating load is eliminated by the operations of the plural compressors, thereby operating the plural compressors.

Next, in a second operation cycle, the plural compressors of the air conditioner repeat their operations/stoppages based on the variation of the room temperature (T).

Here, a time (t2) taken for the plural compressors to be operated/stopped two times at the second operation cycle is sensed. When the sensed time (t2) is not more than the designated time ($t_0$), it is determined that the heating load is eliminated by the operations of only a part of the plural compressors, thereby operating the part of the plural compressors.

In a third operation cycle, the heating load can be eliminated by the operations of only the part of the plural compressors.

Of course, a time (t3) taken for the plural compressors to be operated/stopped two times in the third operation cycle is sensed. The sensed time (t3) is compared to the designated time ($t_0$), and the plural compressors of the air conditioner repeat their operations/stoppages based on the result obtained thereby.

In the third operation cycle, although a time taken for the room temperature (T) to reach the upper limit target temperature ($T_0$+) by the operations of the part of the plural compressors is longer than a time taken for the room temperature (T) to reach the upper limit target temperature ($T_0$+) by the operations of all of the plural compressors, the room temperature (T) relatively rapidly reaches the upper limit target temperature ($T_0$+). Accordingly, the heating load is sufficiently eliminated by the operations of the part of the plural compressors.

The apparatus for controlling the compressors of the air conditioner in accordance with the present invention senses the variation in the room temperature (T) depending on the operations/stoppages of the plural compressors as well as the difference between the room temperature (T) and the target temperature ($T_0$), thereby correctly determining the load and properly operating the plural compressors. Accordingly, it is possible to effectively operate the air conditioner in the heating mode.

The apparatus and method for controlling the compressors of the air conditioner in accordance with the present invention have several advantages, as follows.

First, the apparatus and method for controlling the compressors of the air conditioner of the present invention compare the time taken for the plural compressors to be operated/stopped a designated number of times to a designated time as well as determine the load using the difference between the room temperature and the target temperature, thereby correctly determining the load, properly operating the plural compressors, and thus increasing air conditioning efficiency of the compressors.

Second, the apparatus and method for controlling the compressors of the air conditioner of the present invention prevent the plural compressors to be unnecessarily simultaneously operated, thereby reducing the consumption of power and improving the operational reliability of the compressors.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An apparatus that controls a plurality of compressors of an air conditioner, comprising:

a counter that counts the number of times of operations/stoppages of the plural compressors according to loads;

a timer that senses a time (t) taken for the plural compressors to be operated/stopped a designated number of times counted by the counter; and a controller that controls the number of compressors for operation based on the time (t) sensed by the timer.

2. The apparatus that controls a plurality of compressors of an air conditioner as set forth in claim 1, wherein the timer senses the time (t) taken for the plural compressors to be operated/stopped two times.

3. The apparatus that controls a plurality of compressors of an air conditioner as set forth in claim 1, wherein the controller comprises a comparison unit that compares the time (t) sensed by the timer to a designated time ($t_o$), thereby determining whether or not the load is eliminated.

4. The apparatus that controls a plurality of compressors of an air conditioner as set forth in claim 3, wherein the comparison unit determines the load to be eliminated when the time (t) sensed by the timer is not more than the designated time ($t_o$), and determines the load not to be eliminated when the time (t) sensed by the timer is more than the designated time ($t_o$).

5. The apparatus that controls a plurality of compressors of an air conditioner as set forth in claim 1, wherein the timer is reset when a control signal regarding the time (t) sensed by the timer is transmitted to the controlling unit.

6. The apparatus that controls a plurality of compressors of an air conditioner as set forth in claim 5, wherein the counter is reset when the timer is reset.

7. The apparatus that controls a plurality of compressors of an air conditioner as set forth in claim 1, wherein the controller operates a part of the plural compressors when it is determined that the load is eliminated, and operates all of the plural compressors when it is determined that the load is not eliminated.

8. A method for controlling a plurality of compressors of an air conditioner, comprising:

repeating operations/stoppages of the plural compressors according to loads;

sensing a time (t) taken for the plural compressors to be operated/stopped a designated number (n) of times at the repeating;

determining whether or not the load is eliminated based on the time (t) sensed at the sensing; and selectively operating a part of the plural compressors when it is determined that the load is eliminated depending on the result obtained by the determining.

9. The method for controlling a plurality of compressors of an air conditioner as set forth in claim 8, wherein the time (t) sensed at the sensing is taken for the plural compressors to be operated/stopped two times.

10. The method for controlling a plurality of compressors of an air conditioner as set forth in claim 8, wherein the determining comprises:

determining the load to be eliminated when the sensed time (t) is not more than a designated time ($t_o$); and determining the load not to be eliminated when the sensed time (t) is more than the designated time ($t_o$).

11. The method for controlling a plurality of compressors of an air conditioner as set forth in claim 8, wherein the determining comprises resetting based on a result obtained by comparing the sensed time (t) to a designated time ($t_o$).

12. The method for controlling a plurality of compressors of an air conditioner as set forth in claim 8, wherein the selectively operating comprises operating/stopping the plural compressors the designated number (n) of times at the sensing when it is determined that the load is not eliminated at the determining.

* * * * *